US005478529A

United States Patent [19]

Sobata et al.

[11] Patent Number: 5,478,529

[45] Date of Patent: Dec. 26, 1995

[54] ACTIVITY CONTROL APPARATUS FOR ZINC PHOSPHATE TREATMENT SOLUTION

[75] Inventors: Tamotsu Sobata, Ibaraki; Katsuhiro Takeshita, Hirakata, both of Japan

[73] Assignee: Nippon Paint Co., Ltd., Osaka, Japan

[21] Appl. No.: 231,408

[22] Filed: Apr. 22, 1994

[30] Foreign Application Priority Data

Apr. 23, 1993 [JP] Japan ..... 5-097795

[51] Int. Cl.[6] ..... G05D 7/00

[52] U.S. Cl. ..... 422/111; 422/62; 422/68.1; 422/110; 423/DIG. 5; 210/85; 210/96.1; 210/724

[58] Field of Search ..... 422/106, 108, 422/110, 111, 68.1, 62; 148/241, 260, 262; 423/DIG. 5; 210/96.1, 85, 724, 743

[56] References Cited

U.S. PATENT DOCUMENTS

| | | | |
|---|---|---|---|
| 5,211,769 | 5/1993 | Sobata et al. | 148/260 |
| 5,213,982 | 5/1993 | Soleta et al. | 422/75 |
| 5,300,442 | 4/1994 | Frant | 422/75 |

FOREIGN PATENT DOCUMENTS

| | | |
|---|---|---|
| 838642 | 4/1971 | Canada . |
| 211644 | 12/1983 | Japan . |
| 2306313 | 12/1990 | Japan . |
| 2157446 | 10/1985 | United Kingdom . |

*Primary Examiner*—Robert J. Warden
*Assistant Examiner*—Hien Tran
*Attorney, Agent, or Firm*—Townsend & Banta

[57] ABSTRACT

A treatment solution which is stored in a treatment vessel is supplied to a mixing vessel and a simple fluoride solution is supplied into the mixing vessel from a simple fluoride supply vessel to convert aluminum salt of complex hydrofluoric acid which is contained in the treatment solution to complex hydrofluoric acid. Concentration of HF remaining in the mixed solution is measured with a metal silicon electrode meter provided in an HF concentration measuring part, so that a control signal is transmitted from a control unit to a pump and a flow control part on the basis of the data as obtained. The simple fluoride solution is supplied from the simple fluoride supply vessel to the treatment solution which is stored in the treatment vessel to return the activity of the treatment solution stored in the treatment vessel and to control the same in a prescribed range.

11 Claims, 2 Drawing Sheets

ACTIVITY CONTROL APPARATUS FOR ZINC PHOSPHATE TREATMENT SOLUTION

BACKGROUND OF THE INVENTION

1. Field of the Invention

The present invention relates to an apparatus for controlling the activity of a zinc phosphate treatment solution for forming a zinc phosphate coating on a surface of an aluminum member or an aluminum alloy member, and more particularly, it relates to an apparatus for controlling the activity of a zinc phosphate treatment solution which contains complex hydrofluoric acid as an active material.

2. Description of the Background Art

A zinc phosphate coating is formed on an aluminum material such as an aluminum member or an aluminum alloy member by a method such as that disclosed in Japanese Patent Publication No. 45-16566 (1970), for example. According to this method, a zinc phosphate coating is formed by a zinc phosphate treatment solution containing zinc ions, nitrate ions, phosphate ions, $SiF_6$ ions, iron (II) ions and F ions as main components. When such a zinc phosphate treatment solution contains $SiF_6$ ions and F ions as $H_2SiF_6$ and HF, the surface of the aluminum material is etched and activated through the following chemical formulas:

$$2Al+3H_2SiF_6 \rightarrow Al_2(SiF_6)_3+3H_2$$

$$Al+3HF \rightarrow AlF_3+3/2H_2$$

As understood from the above chemical formulas, HF and $H_2SiF_6$ react with aluminum in the zinc phosphate coating treatment, to form respective aluminum salts. Consequently, free HF and $H_2SiF_6$ concentration levels are reduced by the treatment, leading to reduction of activity levels with respect to the aluminum material. In order to control these activity levels so that the zinc phosphate treatment solution regularly has constant activity, it is necessary to measure the free HF and $H_2SiF_6$ concentration levels.

Japanese Patent Laying-Open No. 58-211644 (1983) discloses an apparatus for controlling activity of a zinc phosphate treatment solution. This apparatus is adapted to sample a constant amount of a target solution from an electrolytic chromic acid treatment solution, add an ionic strength adjuster or the like thereto and thereafter measure fluorine concentration by an ion selective electrode method, for automatically supplying a required amount of a fluoride supplying solution when the fluorine concentration is below a target level. According to this method, complex fluorides such as $H_2SiF_6$ and $HBF_4$ are also measured as fluorine ions ($F^-$). In this method, therefore, it is impossible to measure the activity of a zinc phosphate treatment solution which is mainly composed of complex hydrofluoric acid.

An apparatus which is disclosed in Japanese Patent Laying-Open No. 60-251280 (1985) is also adapted to measure fluorine concentration by a fluorine ion selective electrode method, and hence the activity of complex hydrofluoric acid cannot be measured by this apparatus.

In Japanese Patent Laying-Open No. 2-306313 (1990) which is adapted to directly measure a treatment solution stored in a treatment vessel, a metal silicon electrode meter is provided in the treatment vessel to be in contact with the solution. Also in this method, concentration of complex hydrofluoric acid cannot be measured and hence it is impossible to measure the activity of a treatment solution which is mainly composed of complex hydrofluoric acid.

SUMMARY OF THE INVENTION

An object of the present invention is to provide an apparatus which can measure and control the activity of a zinc phosphate treatment solution containing complex hydrofluoric acid such as $H_2SiF_6$ or $HBF_4$.

The activity control apparatus according to the present invention is adapted to control the activity of a zinc phosphate treatment solution containing complex hydrofluoric acid as an active material in a prescribed range. This apparatus comprises a treatment vessel storing a zinc phosphate treatment solution for zinc phosphate coating formation treatment, sampling means for sampling a prescribed amount of a target solution from the zinc phosphate treatment solution stored in the treatment vessel, first simple fluoride supply means for supplying a simple fluoride solution having known concentration to be added to the target solution, mixing means for homogeneously mixing a prescribed amount of the simple fluoride solution from the first simple fluoride supply means with the target solution for forming a mixed solution, HF concentration measuring means for measuring HF concentration of the mixed solution, and second simple fluoride supply means for evaluating the activity of the target solution through the measurement of HF concentration of the mixed solution and supplying the simple fluoride solution into the zinc phosphate treatment solution which is stored in the treatment vessel on the basis of the evaluation so that the activity of the zinc phosphate treatment solution reaches a level within the prescribed range.

According to the present invention, the first and second simple fluoride supply means may be so formed as to supply the simple fluoride solution from the same simple fluoride supply vessel.

The HF concentration measuring means employed in the present invention can be formed by an apparatus for measuring HF concentration with a metal silicon electrode meter.

The simple fluoride which is added to the target solution can be prepared from HF, NaF, $NaHF_2$, KF, $KHF_2$, $NH_4F$ and/or $NH_4HF_2$. These materials may be independently employed, or combined with each other.

In the activity control apparatus according to the present invention, the sampling means samples a prescribed amount of the zinc phosphate treatment solution from the treatment vessel as a target solution so that a prescribed amount of the simple fluoride solution is added to the target solution from the first simple fluoride supply means to form a mixed solution, and the HF concentration measuring means measures HF concentration of the mixed solution to evaluate the activity of the target solution. When $H_2SiF_6$ is employed as complex hydrofluoric acid in the zinc phosphate treatment solution, for example, $Al_2(SiF_6)_3$ is formed by reaction with aluminum, and the following reaction is caused if HF is added as the simple fluoride, for example:

$$Al_2(SiF_6)_3+12HF \rightarrow 2H_3AlF_6+3H_2SiF_6 \quad (I)$$

Reaction between the aluminum salt of the complex hydrofluoric acid and the simple fluoride progresses in the aforementioned manner, to consume the simple fluoride until the aluminum salt of the complex hydrofluoric acid disappears. Therefore, it is possible to measure the amount of the aluminum salt of the complex hydrofluoric acid for evaluating the activity by adding an excess simple fluoride and measuring the residual part thereof as HF concentration.

HF concentration can be measured with a metal silicon electrode meter, for example, which can be prepared from that disclosed in U.S. Pat. No. 3,329,587, for example. An exemplary device for measuring HF concentration with such a metal silicon electrode meter is SURF PROGUARD 101N (trade name) by Nippon Paint Co., Ltd.

When such a metal silicon electrode meter is employed, hydrogen ion concentration of the target solution is preferably adjusted to be not more than pH 2 so that HF concentration is increased in the following equilibrium state with rightward progress of equilibrium:

$$H^+ + F^- \longleftrightarrow HF$$

Therefore, the inventive apparatus is preferably further provided with a pH adjuster vessel for adding a pH adjuster to the mixed solution, in order to adjust the pH of the target solution to a value of not more than 2. The pH adjuster can be prepared from inorganic acid such as sulfuric acid, hydrochloric acid, nitric acid or phosphoric acid, or organic acid such as acetic acid, citric acid or tartaric acid. When the pH adjuster is prepared from acid forming a treatment solution component employed in the zinc phosphate treatment solution which is stored in the treatment vessel, it is possible to return the target solution into the treatment vessel again. The component of the acid employed in the zinc phosphate treatment solution is phosphoric acid or nitric acid, for example.

When the aforementioned SURF PROGUARD 101N is employed as the metal silicon electrode meter, the simple fluoride is preferably added to the target solution so that the residual part of the simple fluoride is in concentration of 200 to 500 ppm in terms of HF.

According to the present invention, the second simple fluoride supply means supplies the simple fluoride solution into the zinc phosphate treatment solution which is stored in the treatment vessel on the basis of the evaluation of the activity of the target solution, so that activity of the zinc phosphate treatment solution which is stored in the treatment vessel reaches a level within the prescribed range. Thus, the aluminum salt of the complex hydrofluoric acid reacts with the simple fluoride to form complex hydrofluoric acid, thereby increasing the activity of the treatment solution to a level within the prescribed range.

According to the inventive activity control apparatus, it is possible to simply and accurately control the activity of a zinc phosphate treatment solution containing complex hydrofluoric acid as an active material.

According to the present invention, further, it is possible to return the target solution into the treatment vessel again after the measurement. Thus, it is possible to measure the activity for controlling the activity of the treatment solution which is stored in the treatment vessel with no resultant waste liquid.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
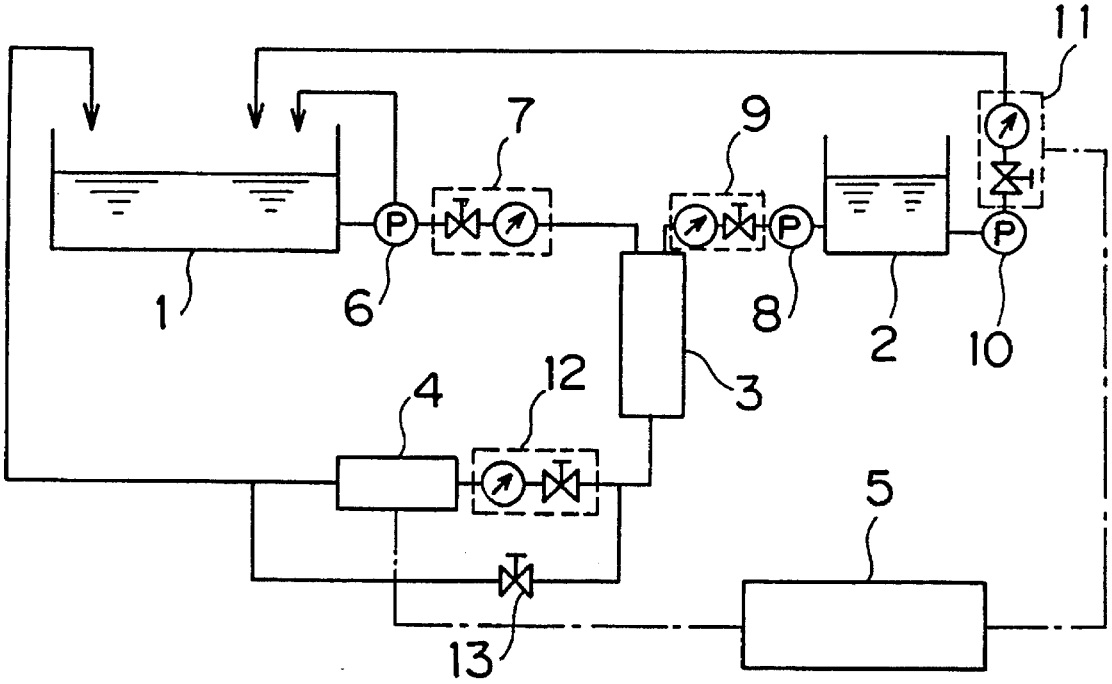
FIG. 1 is a schematic block diagram showing an activity control apparatus according to an embodiment of the present invention.

FIG. 1 is a schematic block diagram showing an activity control apparatus according to an embodiment of the present invention. As shown in FIG. 1, a treatment vessel 1 storing a zinc phosphate treatment solution is provided with a piping for supplying the treatment solution as a target solution to a mixing vessel 3 serving as mixing means, and a pump 6 and a flow control part 7 are provided on this piping to form sampling means. The flow control part 7 is formed by a flow control valve and a flow meter. In the following description, all flow control parts are formed by flow control valves and flow meters respectively.

A simple fluoride supply vessel 2 storing a simple fluoride solution is provided with a piping for supplying the simple fluoride solution to the mixing vessel 3, and this piping is provided with a pump 8 and a flow control part 9. Thus, first simple fluoride supply means is formed. The simple fluoride supply vessel 2 is also provided with another piping for supplying the simple fluoride solution into the treatment vessel 1, and this piping is provided with a pump 10 and a flow control part 11. Thus, second simple fluoride supply means is formed.

The mixing vessel 3 is provided with a piping for supplying a mixed solution to an HF concentration measuring part 4 serving as HF concentration measuring means, and this piping is provided with a flow control part 12. On the other hand, the HF concentration measuring part 4 is provided with a piping for returning the mixed solution into the treatment vessel 1 again after the measurement. Further, a bypass piping is provided between the mixing vessel 3 and the treatment vessel 1 not to pass through the HF concentration measuring part 4, and a flow control valve 13 is provided on this bypass piping.

A measurement data signal indicating HF concentration which is measured in the HF concentration measuring part 4 is transmitted to a control unit 5, which in turn determines the amount of the simple fluoride solution to be supplied to the treatment vessel 1 and transmits a signal for controlling this amount of supply to the pump 10 and the flow control part 11.

The HF concentration measuring part 4 is provided therein with a metal silicon electrode meter, which measures HF concentration of the mixed solution. A structure shown in FIG. 2 is employable for such an HF concentration measuring part 4, for example.

Figure 2:
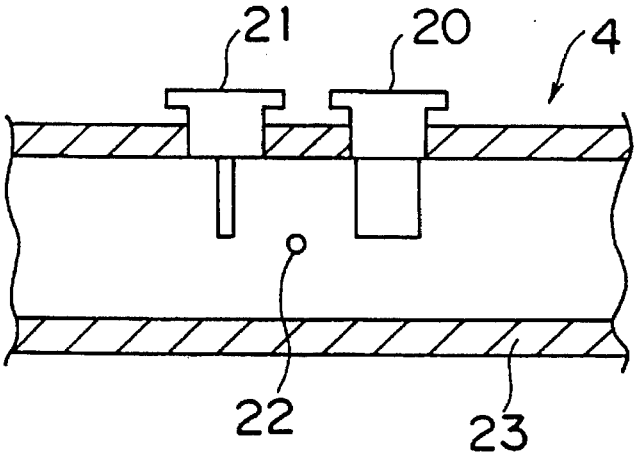
FIG. 2 is a sectional view showing a structure of an HF concentration measuring part which is employable in the activity control apparatus shown in FIG. 1.

Referring to FIG. 2, this HF concentration measuring part 4 comprises a resin pipe 23, and a metal silicon electrode 20 and a platinum electrode 21 for serving as an anode and a cathode for detecting HF concentration, which are provided in the resin pipe 23 to be in contact with the mixed solution flowing in the piping 23. Another platinum electrode 22 for serving as a counter electrode for the cathode in electrolytic cleaning is provided in the pipe 23 perpendicularly to the metal silicon electrode 20 and the platinum electrode 21. Due to this structure, it is possible to measure the HF concentration of the mixed solution flowing in the pipe 23.

Figure 3:
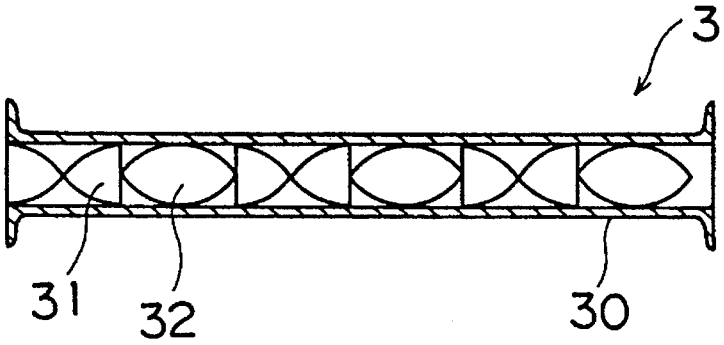
FIG. 3 is a sectional view showing a structure of a mixing vessel which is employable in the activity control apparatus shown in FIG. 1.

The mixing vessel 3 can be formed by a continuous mixing/stirring apparatus shown in FIG. 3, for example. The continuous mixing/stirring apparatus shown in FIG. 3, called a static mixer, comprises a pipe 30, and spiral elements 31 and 32, twisted rightward and leftward by 180° respectively, which are alternately arranged in the pipe 30 to perpendicularly intersect with each other. Fluids which are introduced into the pipe 30 having the aforementioned structure are first split by the first one of the elements 31 to flow along the shape of this element 31, and then further split by the next the element 32. Thus, the fluids are successively split by the rightwardly and leftwardly twisted elements 31 and 32 which are alternately arranged in the pipe 30, whereby flows thereof are inverted and the different fluids are mixed with each other.

Description is now made on the operation of the activity control apparatus shown in FIG. 1 for controlling the activity of the zinc phosphate treatment solution.

In the apparatus shown in FIG. 1 which is adapted to continuously measure and control the activity of the zinc phosphate treatment solution stored in the treatment vessel 1, a constant amount of the zinc phosphate treatment solution stored in the treatment vessel 1 is supplied into the mixing vessel 3 as a target solution. The target solution is supplied through the pump 6 and the flow control part 7 into the mixing vessel 3 at a prescribed flow rate. On the other hand, the simple fluoride solution is also supplied into the mixing vessel 3 from the simple fluoride supply vessel 2 through the pump 8 and the flow control part 9.

In the mixing vessel 3, therefore, the target solution supplied from the treatment vessel 1 and the simple fluoride solution supplied from the simple fluoride supply vessel 2 are homogeneously mixed with each other at a prescribed ratio. Thereafter the mixed solution is fed from the mixing vessel 3 to the HF concentration measuring part 4, to be subjected to measurement of HF concentration. After the measurement of HF concentration, the mixed solution is returned to the treatment vessel 1. The target solution which is sampled from the treatment solution stored in the treatment vessel 1 can be refluxed at a flow rate of 5 l/min., for example. When the simple fluoride supply vessel 2 stores a mixed solution of $KHF_2$ and KF in concentration of 10.2 gHF/100 ml in terms of HF as the simple fluoride solution so that this simple fluoride solution is added to the target solution by 300 ppm in terms of HF concentration, for example, the simple fluoride solution is so supplied into the mixing vessel 3 that its flow rate is 14.7 ml/min. with respect to the flow rate of 5 l/min. of the target solution.

The mixed solution obtained in the mixing vessel 3 is fed to the HF concentration measuring part 4, while it is possible to adjust the amount of the mixed solution passing through the HF concentration measuring part 4 by the flow control part 12 and the flow control valve 13, due to the aforementioned bypass piping. For example, it is possible to arbitrarily set the amount of the mixed solution passing through the HF concentration measuring part 4 in a range of 2 to 5 l/min.

As hereinabove described, the simple fluoride solution is added to the treatment solution which is supplied to the mixing vessel 3, in an amount exceeding 12 times the molar quantity of aluminum salt of the complex hydrofluoric acid contained in the treatment solution. Thus, the aluminum salt of the complex hydrofluoric acid contained in the treatment solution is converted to complex hydrofluoric acid as described above. Then, this mixed solution is fed to the HF concentration measuring part 4, which in turn measures concentration of residual HF. Measurement data of this HF concentration is transmitted to the control unit 5, which in turn calculates concentration of consumed HF from the amount of the simple fluoride solution added to the treatment solution and the HF concentration as measured, thereby calculating the activity of the treatment solution, which is the target solution. The control unit 5 further calculates the amount of the simple fluoride solution to be added to the treatment solution which is stored in the treatment vessel 1 on the basis of the activity as calculated, and transmits a control signal to the pump 10 and the flow control part 11. On the basis of the transmitted signal, a prescribed amount of the simple fluoride solution is supplied from the simple fluoride supply vessel 2 into the treatment vessel 1 through the pump 10 and the flow control part 11.

The simple fluoride solution which is added into the treatment vessel 1 reacts with aluminum salt of the complex hydrofluoric acid contained in the treatment solution which is stored in the treatment vessel 1, and converts the same to complex hydrofluoric acid, thereby returning the activity and controlling the same to a level within the prescribed range.

When the apparatus shown in FIG. 1 is employed, it is possible to control the activity of the treatment solution in the prescribed range by continuously sampling the target solution from the treatment vessel 1 for measuring its activity and adding a proper amount of the simple fluoride solution into the treatment vessel on the basis of the result of the measurement.

The mixing vessel 3 is not restricted to the aforementioned structure of the static mixer, but may be formed by another means so far as the same can homogeneously mix a plurality of fluids with each other in high efficiency.

Further, means for supplying the target solution and the simple fluoride solution into the mixing vessel 3 at a prescribed ratio are not restricted to the flow control parts 7 and 9 shown in FIG. 1, but the same may alternatively be prepared from means which can supply two fluids at a constant ratio. For example, orifice plates may be provided on the pipings so that the simple fluoride solution is injected into the piping feeding the target solution to be mixed with the target solution through the so-called self-operated ratio injection valve, such as that by Nippon Flow Cell Co., Ltd., for example, which can inject a fluid into a pipe so that pressure difference of a setting valve is regularly equal to that of an orifice.

EXAMPLE 2

Figure 4:
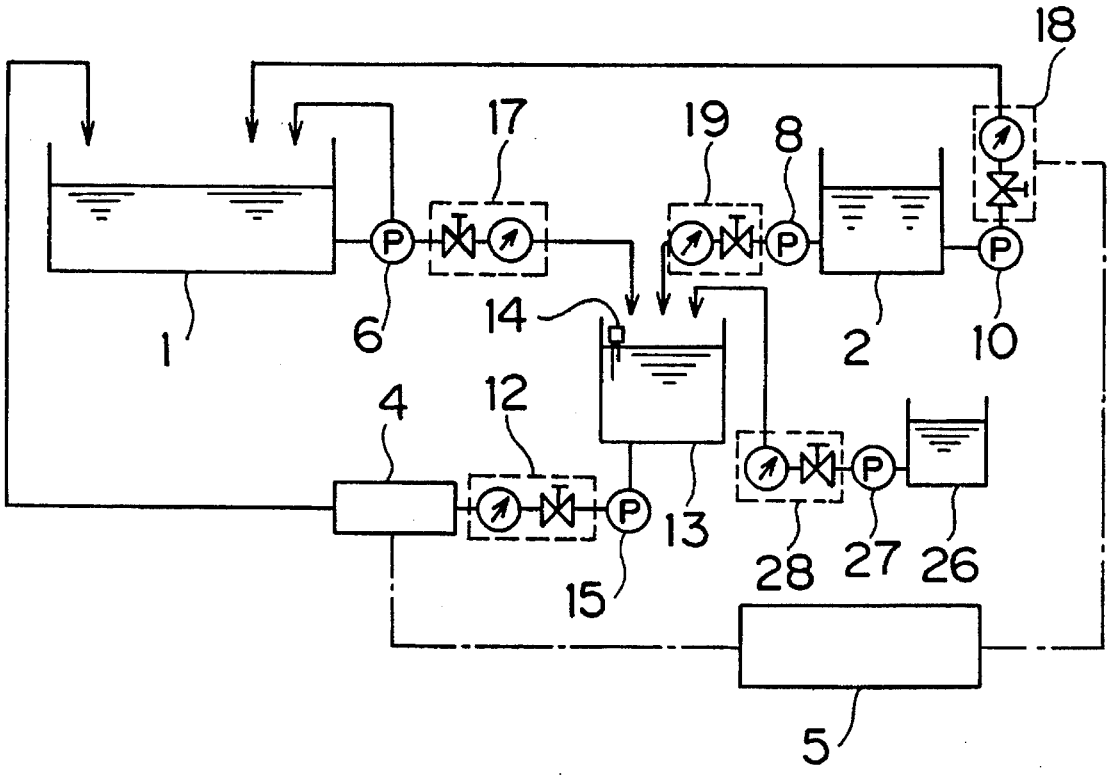
FIG. 4 is a schematic block diagram showing an activity control apparatus according to another embodiment of the present invention.

FIG. 4 is a schematic block diagram showing an activity control apparatus according to another embodiment of the present invention. The control apparatus according to this embodiment is adapted to periodically sample a treatment solution which is stored in a treatment:vessel and add prescribed amounts of a simple fluoride solution and a pH adjuster thereto for measuring HF concentration.

Referring to FIG. 4, a piping is provided between a treatment vessel 1 and a mixing vessel 13 for supplying a target solution which is sampled from the treatment vessel 1 into the mixing vessel 13. This piping is provided with a pump 6 and a quantitative supply unit 17, which form sampling means. The quantitative supply unit 17 is formed by a control valve and a flow meter. Another piping is provided for supplying a simple fluoride solution from a simple fluoride supply vessel 2 into the mixing vessel 13, and this piping is provided with a pump 8 and a quantitative supply unit 19. Thus, first simple fluoride supply means is formed. Further, a pH adjuster vessel 26 is provided for adjusting the pH value of the target solution which is supplied to the mixing vessel 13, and a piping is provided for supplying a pH adjuster from the pH adjuster vessel 26 into the mixing vessel 13. This piping is provided with a pump 27 and a quantitative supply unit 28.

Further, a level controller 14 is provided in the mixing vessel 13.

The mixing vessel 13 is provided with a piping for supplying a mixed solution into an HF concentration measuring part 4, and this piping is provided with a pump 15 and a flow control part 12. The HF concentration measuring part 4 has a structure which is similar to that of the aforementioned embodiment 1. This HF concentration measuring part 4 is provided with a piping for returning the target solution to the treatment vessel 1 after measurement.

The simple fluoride supply vessel 2 is provided with a piping for adding the simple fluoride solution into the treatment solution which is stored in the treatment vessel 1, and this piping is provided with a pump 10 and a quantitative supply unit 18. Thus, second simple fluoride supply means is formed.

A signal indicating measurement data of HF concentration measured in the HF concentration measuring part 4 is transmitted to a control unit 5, which in turn transmits a control signal indicating the amount of the simple fluoride solution to be added to the treatment solution stored in the treatment vessel 1 to the pump 10 and the quantitative supply unit 18.

A constant amount of the treatment solution is supplied from the treatment vessel 1 into the mixing vessel 13 through the pump 6 and the quantitative supply unit 17. The activity control apparatus shown in FIG. 4 is so designed as to periodically supply the treatment solution from the treatment vessel 1 into the mixing vessel 13 as a target solution. When the mixing vessel 13 is 200 l in capacity, for example, 100 l of the treatment solution is supplied from the treatment vessel 1 into the mixing vessel 13 every time the mixed solution which is stored in the mixing vessel 13 is reduced by 100 l. At this time, the level controller 14 provided in the mixing vessel 13 controls the amount of the treatment solution for preventing the mixing vessel 13 from an overflow.

The simple fluoride solution is added from the simple fluoride supply vessel 2 to the treatment solution which is supplied into the mixing vessel 13. When the simple fluoride solution is prepared from a mixed solution of $KHF_2$ and KF in concentration of 10.2 gHF/100 ml in terms of HF, for example, 0.294 l of the simple fluoride solution is added to 100 l of the treatment solution.

Further, the activity control apparatus according to this embodiment is provided with the pH adjuster vessel 26, so that a prescribed amount of the pH adjuster is added into the mixing vessel 13 from this pH adjuster vessel 26. According to this embodiment, the pH adjuster is prepared from an aqueous solution of phosphoric acid. As to the amount of the pH adjuster, a pH meter is mounted on the mixing vessel 13 so that the pH adjuster is added to adjust the mixed solution which is stored in the mixing vessel 13 to pH 1.5, for example. It is possible to suppress formation of a fluorine compound containing aluminum by adding the pH adjuster as shown in the following reaction formulas, thereby preventing the HF concentration measuring part 4 and the circulation system of the apparatus from accumulation and concentration of sludge:

$$6NaHF_2+Al_2(SiF_6)_3 \rightarrow 2Na_3AlF_6+3H_2SiF_6$$

$$Na_3AlF_6+3H_3PO_4 \rightarrow H_3AlF_6+3NaH_2PO_4$$

In the mixing vessel 13, the simple fluoride solution and the pH adjuster are added to the treatment solution, so that aluminum salt of the complex hydrofluoric acid contained in the treatment solution is converted to complex hydrofluoric acid. This mixed solution is supplied from the mixing vessel 13 into the HF concentration measuring part 4. The HF concentration measuring part 4 measures concentration of HF remaining in the mixed solution as supplied. Measurement data of this HF concentration is transmitted to the control unit 5. The control unit 5 obtains concentration of the simple fluoride consumed by the treatment solution from the measurement data of HF concentration thereby evaluating the activity of the treatment solution, and calculates the amount of the simple fluoride solution which is necessary for returning the activity of the treatment solution into the prescribed range in the treatment vessel 1. The control unit 5 transmits a control signal indicating the amount of the simple fluoride solution to be added to the treatment solution to the pump 10 and the quantitative supply unit 18, so that the prescribed amount of the simple fluoride solution is supplied from the simple fluoride supply vessel 2 into the treatment vessel 1. The simple fluoride which is supplied into the treatment vessel 1 reacts with aluminum salt of the complex hydrofluoric acid contained in the treatment solution, to form complex hydrofluoric acid. Thus, the activity of the treatment solution is returned and controlled in the prescribed range.

While the activity control apparatus according to the present invention has been described with reference to embodiments, the inventive activity control apparatus is not restricted to the structures of the aforementioned embodiments.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An activity control apparatus for controlling an activity of a zinc phosphate treatment solution in a prescribed range, said activity control apparatus comprising:

a treatment vessel containing zinc phosphate treatment solution comprising complex hydrofluoric acid as an activity material;

sampling means for obtaining a sample solution from said zinc phosphate treatment solution in said treatment vessel;

first simple fluoride supply means for supplying from a source of simple fluoride solution an excessive amount of said simple fluoride solution to be added to said sample solution;

mixing means for homogeneously mixing said simple fluoride solution from said first simple fluoride supply means with said sample solution from said treatment vessel to produce a mixed solution, thereby to react a salt of complex hydrofluoric acid in said sample solution with said excessive amount of simple fluoride to substantially convert said salt into complex hydrofluoric acid;

measuring means for determining HF concentration of simple fluoride remaining in said mixed solution after reaction;

evaluating means for determining activity of said sample solution by calculating consumption of simple fluoride in conversion into complex hydrofluoric acid based on HF concentration of simple fluoride remaining in said mixed solution;

second simple fluoride supply means connected to a second source of simple fluoride solution for supplying said simple fluoride solution to be added to said zinc phosphate treatment solution in said treatment vessel; and means for adding said simple fluoride solution from said second simple fluoride supply means to said zinc phosphate treatment solution in said treatment vessel in an amount determined by said evaluating means, to react a salt of complex hydrofluoric acid in said zinc phosphate treatment solution with a simple fluoride to convert said salt into complex hydrofluoric acid, thereby to control the activity of said zinc phosphate treatment solution in said treatment vessel.

2. An activity control apparatus in accordance with claim 1, wherein said first and second sources of simple fluoride solution are the same source.

3. An activity control apparatus in accordance with claim 1, wherein said measuring means comprises a metal silicon electrode meter.

4. An activity control apparatus in accordance with claim 1, wherein said sampling means is constructed and arranged for continuously sampling a sample solution.

5. An activity control apparatus in accordance with claim 1, wherein said sampling means is constructed and arranged for periodically sampling a sample solution.

6. An activity control apparatus in accordance with claim 5, further comprising means for adding a pH adjuster to said mixed solution of said sample solution and said simple fluoride solution in said mixing vessel.

7. An activity control apparatus in accordance with claim 1, further comprising means for returning said mixed solution after measurement to said treatment vessel.

8. An activity control apparatus in accordance with claim 1, wherein said zinc phosphate treatment solution is substantially free of simple fluoride ion.

9. An activity control apparatus in accordance with claim 4, wherein said sampling means comprises a pump for continuously sampling and supplying a sample solution to said mixing means, and a flow controller for controlling a flow rate of said sample solution supplied through said pump.

10. An activity control apparatus in accordance with claim 4, wherein said mixing means comprises a continuous mixing/stirring apparatus for continuously mixing said sample solution with said simple fluoride solution supplied from said first simple fluoride vessel.

11. An activity control apparatus in accordance with claim 5, wherein said sampling means comprises a pump for periodically sampling and supplying a sample solution to said mixing means, and a supply unit for quantitatively supplying said sample solution through said pump to said mixing means.

* * * * *